US012560052B2

(12) United States Patent
Deshpande et al.

(10) Patent No.: US 12,560,052 B2
(45) Date of Patent: Feb. 24, 2026

(54) COMPENSATOR ASSEMBLY FOR DOWNHOLE TOOL ARTICULATION SYSTEMS AND METHODS

(71) Applicant: SCHLUMBERGER TECHNOLOGY CORPORATION, Sugar Land, TX (US)

(72) Inventors: Tejas Deshpande, Houston, TX (US); Bo Chen, Rosharon, TX (US); Brian Walther, Rosharon, TX (US)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 0 days.

(21) Appl. No.: 19/133,253

(22) PCT Filed: Dec. 14, 2023

(86) PCT No.: PCT/US2023/084031
§ 371 (c)(1),
(2) Date: May 28, 2025

(87) PCT Pub. No.: WO2024/129973
PCT Pub. Date: Jun. 20, 2024

(65) Prior Publication Data

US 2026/0009308 A1 Jan. 8, 2026

(30) Foreign Application Priority Data

Dec. 14, 2022 (IN) ..... 202221072162

(51) Int. Cl.
*E21B 34/10* (2006.01)
*E21B 34/08* (2006.01)
*E21B 34/14* (2006.01)

(52) U.S. Cl.
CPC ..... *E21B 34/14* (2013.01); *E21B 34/08* (2013.01)

(58) Field of Classification Search
CPC ..... E21B 34/08; E21B 34/10
See application file for complete search history.

(56) References Cited

U.S. PATENT DOCUMENTS 4,173,256 A * 11/1979 Kilgore ..... E21B 34/10 166/324
5,251,703 A * 10/1993 Skinner ..... E21B 23/04 166/66.4

(Continued)

FOREIGN PATENT DOCUMENTS

WO 2022010993 A1 1/2022

OTHER PUBLICATIONS

International Search Report and Written Opinion of International Patent Application No. PCT/US2023/084031 dated on Apr. 24, 2024, 11 pages.

*Primary Examiner* — Kenneth L Thompson
(74) *Attorney, Agent, or Firm* — Jeffrey D. Frantz

(57) ABSTRACT

A valve system of a well string may include a compensator assembly to receive a pipe fluid from piping and include a piston chamber and a piston disposed within the piston chamber that fluidly isolates a first portion from a second portion of the piston chamber. The first portion is fluidly coupled to the piping and the second portion is filled with a hydraulic fluid and coupled to one or more hydraulic lines. The piston may translate within the piston chamber such that an increase in pressure of the pipe fluid motivates the piston to translate and increase the pressure of the hydraulic fluid. The valve system may also include a mechanical actuator coupled to a hydraulic line to articulate an armature in response to a pressure differential that is based on the second (Continued)

pressure and a valve that opens or closes in response to articulation via the armature.

13 Claims, 6 Drawing Sheets

(56) References Cited

U.S. PATENT DOCUMENTS

| | | | | |
|---|---|---|---|---|
| 7,363,980 | B2 * | 4/2008 | Pringle | E21B 34/08 166/332.8 |
| 7,552,774 | B2 * | 6/2009 | Anderson | E21B 34/101 166/321 |
| 7,690,432 | B2 * | 4/2010 | Noske | E21B 34/06 166/332.8 |
| 7,694,742 | B2 * | 4/2010 | Bane | E21B 23/065 166/374 |
| 10,208,568 | B2 * | 2/2019 | Hill | E21B 34/14 |
| 11,643,905 | B2 * | 5/2023 | Vick, Jr. | E21B 34/04 166/344 |
| 2011/0232917 | A1 | 9/2011 | Skinner | |
| 2014/0000908 | A1 | 1/2014 | Abdelall | |
| 2016/0281465 | A1 | 9/2016 | Grayson | |
| 2017/0184082 | A1 | 6/2017 | Domke | |

* cited by examiner

COMPENSATOR ASSEMBLY FOR DOWNHOLE TOOL ARTICULATION SYSTEMS AND METHODS

CROSS-REFERENCE TO RELATED APPLICATION

This application is a National Stage Entry of International Application No. PCT/US2023/084031, filed Dec. 14, 2023 claiming priority to and the benefit of India Provisional Application No. 20/222,1072162, entitled "POSITIONAL-RELEASE MECHANISM FOR A DOWNHOLE TOOL," filed Dec. 14, 2022, which is hereby incorporated by reference in its entirety for all purposes.

BACKGROUND

This disclosure relates to downhole tool strings and actuation of components thereof. In particular, the present disclosure relates to a tubing compensator that utilizes a pressurized fluid within tubing that may include debris or other impurities to pressurize an isolated fluid for actuating another component of a tool string, such as a valve.

This section is intended to introduce the reader to various aspects of art that may be related to various aspects of the present techniques, which are described and/or claimed below. This discussion is believed to be helpful in providing the reader with background information to facilitate a better understanding of the various aspects of the present disclosure. Accordingly, it should be understood that these statements are to be read in this light, and not as an admission of any kind.

The extraction of natural resources such as hydrocarbons from a geological formation is typically a multi-step endeavor utilizing a variety of tools and techniques. In general, wells to extract resources include a drilled wellbore into which downhole tools are deployed. Well completion is obtained when piping is put in place to allow for the production of resources from the geological formation.

In addition to piping, one or more valves may be utilized to selectively isolate portions of the wellbore and/or production piping. For example, an isolation valve may be utilized in downhole completion equipment to provide two-way isolation from the formation. Such double isolation may allow for completion operations (e.g., installation of completion equipment) without additional blocking (e.g., placing a column of fluid in the wellbore) of reservoir fluids from rising through the wellbore and/or being prematurely produced through the production piping. Moreover, isolation valves or other valves may also be used for a broad range of downhole applications including prevention of fluid loss, packer setting, and lateral isolation, to name a few.

As should be appreciated, reliable actuation of an isolation valve or other component of a downhole tool may be of particular importance in downhole operations. Indeed, the inability to shift open or close a downhole valve may lead to lost resources and/or sizable expenditures in time, labor, and/or materials to replace or circumvent failed components. As such, there is desire for a robust and reliable system for actuating downhole valves.

SUMMARY

A summary of certain embodiments disclosed herein is set forth below. It should be understood that these aspects are presented merely to provide the reader with a brief summary of these certain embodiments and that these aspects are not intended to limit the scope of this disclosure. Indeed, this disclosure may encompass a variety of aspects that may not be set forth below.

Indeed, in one example, a valve system of a well string may include a compensator assembly to receive a pipe fluid from piping and include a piston chamber and a piston disposed within the piston chamber that fluidly isolates a first portion of the piston chamber from a second portion of the piston chamber. The first portion is fluidly coupled to the piping to receive the pipe fluid and the second portion is filled with a hydraulic fluid and coupled to one or more hydraulic lines. Additionally, the piston may have a degree of freedom to translate within the piston chamber such that an increase in a first pressure of the pipe fluid in the first portion of the piston chamber motivates the piston to translate and increase a second pressure of the hydraulic fluid in the second portion of the piston chamber. The valve system may also include a mechanical actuator coupled to at least one of the hydraulic lines to articulate an armature in response to a pressure differential that is based on the second pressure. The valve system may also include a valve that transitions between an open state and a closed state in response to articulation via the armature.

In another embodiment, a compensator assembly of a well string may include a first annular wall disposed about an axis, a second annular wall disposed radially outward from the first annular wall relative to the axis, and an annular piston chamber disposed radially about the axis between the first annular wall and the second annular wall. The first annular wall may include piping that conveys a pipe fluid in an axial direction relative to the axis. The compensator assembly may also include an annular piston disposed within the annular piston chamber to fluidly isolate a first portion of the annular piston chamber from a second portion of the annular piston chamber. The first portion may be fluidly coupled to the piping to receive the pipe fluid and the second portion may be filled with a hydraulic fluid and coupled to one or more hydraulic lines. Additionally, the annular piston may have a degree of freedom in the axial direction within the annular piston chamber such that an increase in a first pressure of the pipe fluid in the first portion of the annular piston chamber motivates the annular piston to translate axially and increase a second pressure of the hydraulic fluid in the second portion of the annular piston chamber.

In another embodiment, a method of operating a downhole valve system may include receiving, via a filter assembly of a compensator assembly, pipe fluid into a first portion of a piston chamber of the compensator assembly from downhole piping and pressurizing the pipe fluid within the first portion of the piston chamber. The method may also include translating a piston of the compensator assembly within the piston chamber to pressurize hydraulic fluid in a second portion of the piston chamber fluidly coupled to one or more hydraulic lines to a second pressure based on the first pressure. The piston may fluidly isolate the first portion of the piston chamber from the second portion of the piston chamber. The method may also include providing, via the one or more hydraulic lines, the hydraulic fluid at the second pressure to a mechanical actuator and, in response to activation of a trigger, reducing a third pressure of a controlled hydraulic line fluidly coupled to the mechanical actuator to generate a pressure differential between the third pressure and the second pressure at the mechanical actuator. Moreover, the method may include motivating an armature of the mechanical actuator based on the pressure differential and actuating a valve of the downhole piping via the armature.

Various refinements of the features noted above may be undertaken in relation to various aspects of the present disclosure. Further features may also be incorporated in these various aspects as well. These refinements and additional features may exist individually or in any combination. For instance, various features discussed below in relation to one or more of the illustrated embodiments may be incorporated into any of the above-described aspects of the present disclosure alone or in any combination. The brief summary presented above is intended to familiarize the reader with certain aspects and contexts of embodiments of the present disclosure without limitation to the claimed subject matter.

BRIEF DESCRIPTION OF THE DRAWINGS

Various aspects of this disclosure may be better understood upon reading the following detailed description and upon reference to the drawings in which.

DETAILED DESCRIPTION

Figure 1:
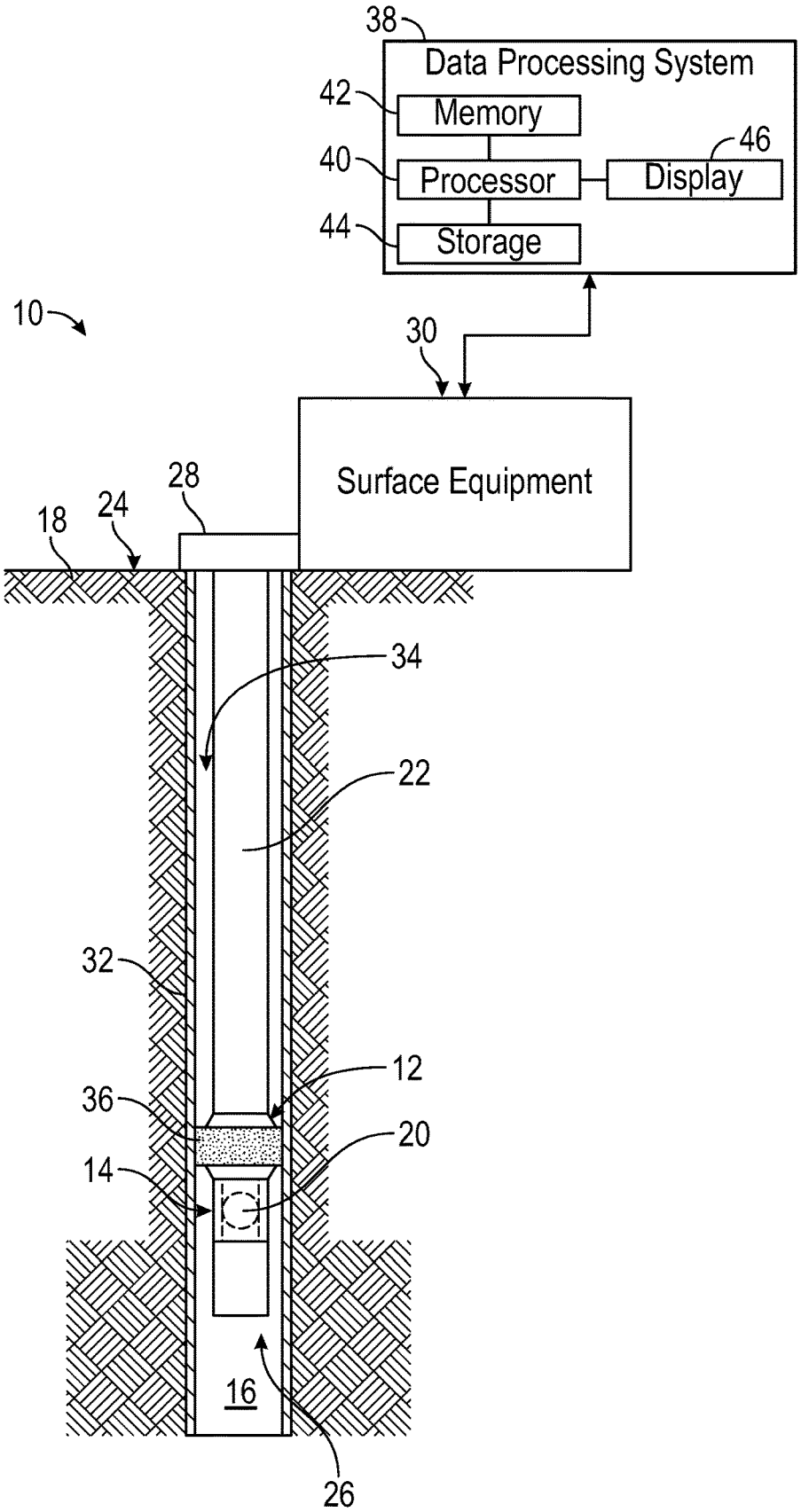
FIG. 1 is an example of a well system with a well string having a valve system deployed in a wellbore of a geological formation, in accordance with an embodiment.

One or more specific embodiments of the present disclosure will be described below. These described embodiments are examples of the presently disclosed techniques. Additionally, in an effort to provide a concise description of these embodiments, the features of an actual implementation may not be described in the specification. It should be appreciated that in the development of any such actual implementation, as in any engineering or design project, numerous implementation-specific decisions may be made to achieve the developers' specific goals, such as compliance with system-related and business-related constraints, which may vary from one implementation to another. Moreover, it should be appreciated that such a development effort might be complex and time consuming, but would be a routine undertaking of design, fabrication, and manufacture for those of ordinary skill having the benefit of this disclosure.

When introducing elements of various embodiments of the present disclosure, the articles "a," "an," and "the" are intended to mean that there are one or more of the elements. The terms "comprising," "including," and "having" are intended to be inclusive and mean that there may be additional elements other than the listed elements. Additionally, it should be understood that references to "one embodiment" or "an embodiment" of the present disclosure are not intended to be interpreted as excluding the existence of additional embodiments that also incorporate the recited features.

The oil and gas industry includes a number of sub-industries, such as exploration, drilling, logging, extraction, transportation, refinement, retail, and so forth. During exploration and drilling, wellbores may be drilled into the ground for reasons that may include discovery, observation, or extraction of resources. These resources may include oil, gas, water, or any other combination of elements within the ground.

Wellbores, sometimes called boreholes, may be straight or curved holes drilled into the ground from which resources may be discovered, observed, and/or extracted. During and/or after the establishment of a wellbore, well logging may be practiced. Well logging may include making a detailed record of the geological formations penetrated by a wellbore, and is generally part of the discovery and observation of resources. In general, well logging may provide the basis for choosing to perform well completion.

Well completion may include outfitting of the wellbore with piping, valves (e.g., valve systems), or other components such as packers to facilitate production of reservoir fluids (e.g., hydrocarbons or other resource of interest). Piping may provide a conduit for carrying reservoir fluids to the surface and/or to allow for pumped fluid from the surface to enter the wellbore and/or pressurize the piping. Valves may be utilized to isolate different portions of the wellbore and/or piping, such as to optimize production and/or ease completion of the wellbore.

A valve system may include components for actuating a valve (e.g., ball valve, sleeve valve, gate valve, flapper valve, etc.) between open and closed states. For example, in some embodiments, an isolation valve may be coupled to an actuator system having a mechanical actuator that is motivated based on hydraulic pressure from a compensator assembly and controlled, at least in part, by a trigger. The compensator assembly may provide an interface between an isolated hydraulic fluid of the valve system and pressurized fluid within the piping (e.g., formation fluid, pumped fluid from the surface, or a combination thereof). Indeed, in some scenarios, the pressurized fluid within the piping may include particulate matter or fluid compounds that could cause clogging of hydraulic lines of the valve system and/or prevent movement of the mechanical actuator. As such, the compensator assembly may include a piston chamber with piston fluidly coupled to and providing isolation between the pressurized fluid within the piping and the hydraulic fluid (e.g., hydraulic oil or other liquid). Additionally, the piston may be a floating piston, such that the piston is free to slide within the piston based on the relative pressures of the pressurized fluid within the piping and the hydraulic fluid. For example, when the pressure of the fluid within the piping increases, the piston may move within the piston chamber, motivating the hydraulic fluid in the hydraulic lines. In some embodiments, the hydraulic lines may be coupled with a trigger and/or the mechanical actuator to provide for actuation of the valve.

As should be appreciated, while discussed herein in the context of an isolation valve utilized for well completion, the present techniques may be applicable to actuate any component (e.g., valve, packer, or other downhole tool) of a downhole system using the compensator assembly discussed herein. Indeed, the compensator assembly may be utilized for transferring the potential energy of a pressurized fluid to a hydraulic system for well completion, pre-production, and/or post-production operations.

With the foregoing in mind, FIG. 1 illustrates an example of a well system 10 with a well string 12 (e.g., well completion string, bottom hole assembly (BHA), well logging string, etc.) having a valve system 14 deployed in a wellbore 16 of a geological formation 18. The valve system 14 may include one or more valves 20 (e.g., isolation valves) to selectively facilitate a flow of fluids (e.g., formation fluid, fluid pumped from the surface of the geological formation 18, or combination thereof) through piping 22 between the surface 24 and downhole 26 environments. Furthermore, a wellhead 28 may be disposed at the surface 24 of the well system 10 and include or interface with surface equipment 30 to control, monitor, or otherwise work in conjunction with the well string 12. For example, the surface equipment 30 may include one or more sensors, one or more pumps, one or more valves, communication equipment, winch or other relaying systems, mechanical connections with the well string 12, fluid connections with the well string 12, and/or electrical connections with the well string 12.

Additionally, in some embodiments, the well system 10 may include a liner or casing 32 along the sidewall of the wellbore 16, which may include pipe, cement, and/or other materials. Furthermore, the wellbore 16 (e.g., with or without a casing 32) may form an annulus 34 around the piping 22 and/or other components of the well string 12. In some embodiments, the well string 12 may include additional components such as a packer 36, which may form a seal in the annulus 34 separating sections of the wellbore 16. Moreover, while depicted as a land-based well system 10, in some embodiments, the techniques discussed herein may also be utilized in subsea and/or offshore applications. Indeed, as discussed further below, while discussed herein in the context of a valve system 14 utilized in well completion, aspects of the present disclosure may be utilized in any suitable context to utilize pressure within piping 22 of a downhole system to pressurize an isolated hydraulic system, for example to motivate mechanical actuators.

The well string 12 may receive energy from a downhole power source or from the surface equipment 30. Moreover, in some embodiments, the surface equipment 30 may send control signals to the well string 12 to facilitate operation of the well string 12. For example, the nature of the control signals may be electric, electromagnetic, acoustic, optical, chemical, a series of pressure pulses, a pressure differential, and/or a temperature differential. Moreover, in some embodiments, a data processing system 38 may be implemented as part of and/or coupled to the surface equipment 30 and/or well string 12 to control operations of the surface equipment 30 and well string 12. The data processing system 38 may be any electronic data processing system that can be used to carry out the systems and methods of this disclosure. For example, the data processing system 38 may include a processor 40, which may execute instructions stored in memory 42 and/or storage 44. As such, the memory 42 and/or the storage 44 of the data processing system 38 may be any suitable article of manufacture that can store the instructions. For example, the memory 42 and/or the storage 44 may be read-only memory (ROM), random-access memory (RAM), flash memory, an optical storage medium, or a hard disk drive, to name a few examples. Additionally, in some embodiments, a display 46, which may be any suitable electronic display, may display images generated by the processor 40, such as alerts and status indicators, and/or to facilitate operator control of the well system 10. The data processing system 38 may be a local component of the well system 10 (e.g., at the surface 24), a part of the well string 12, a remote device that analyzes data received from the surface equipment 30 and/or well string 12, a cloud computing device, or any combination thereof. In some embodiments, the data processing system 38 may be a mobile computing device (e.g., tablet, smart phone, or laptop), a server remote from the well system 10, or a combination thereof.

As discussed above, well completion and/or other downhole activities may include outfitting the wellbore 16 with a well string 12 of piping 22 and one or more valve systems 14. The piping 22 may provide a conduit for carrying reservoir fluids from downhole 26 to the surface 24 and/or to allow for pumped fluid from the surface 24 to reach downhole 26. Valves 20, such as isolation valves, may be utilized to allow or block fluid flow between different portions of the wellbore 16 and/or piping 22, such as to optimize production and/or ease completion of the wellbore 16.

Figure 2:
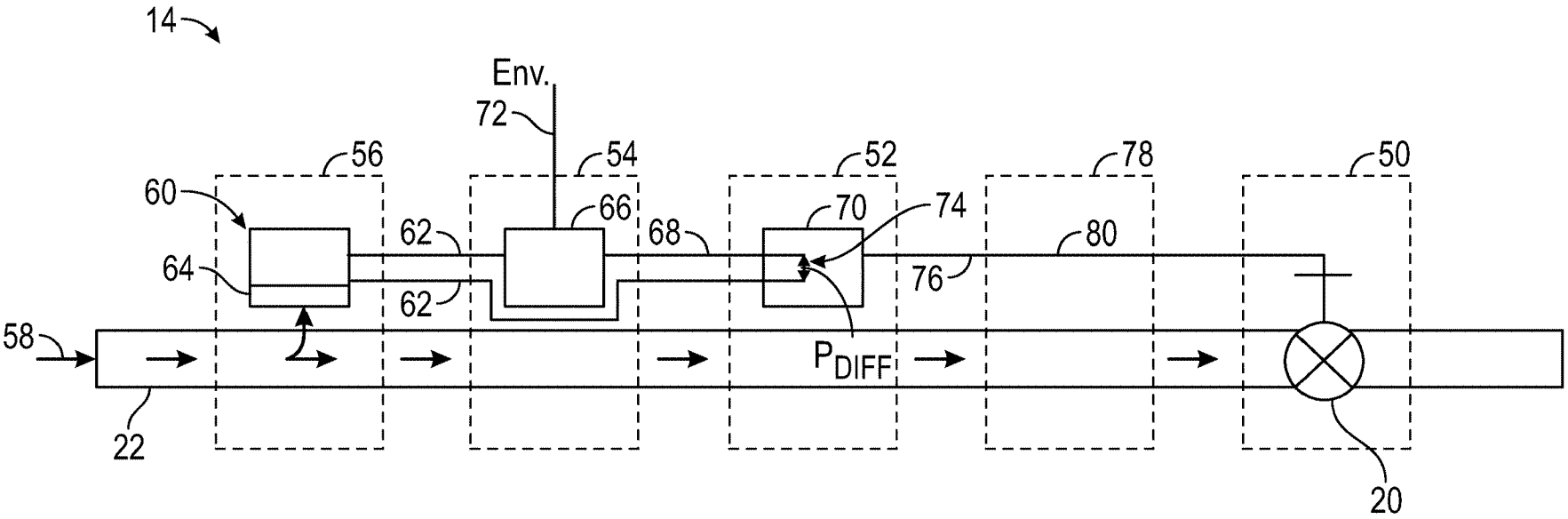
FIG. 2 is a schematic flow diagram of an example of the valve system of FIG. 1, in accordance with an embodiment.

As should be appreciated, reliable actuation of the valve(s) 20 included in a downhole valve system 14 may be of particular importance in downhole operations. Indeed, the inability to shift open or close a downhole valve may lead to lost resources and/or sizable expenditures in time, labor, and/or materials to replace or circumvent failed components. With the foregoing in mind, FIG. 2 is a schematic flow diagram of an example valve system 14 including a valve section 50, an actuator section 52, a trigger section 54, and a compensator section 56.

The valve section 50 may include one or more valves 20 (e.g., ball valve, sleeve valve, gate valve, flapper valve, etc.) actuatable between open and closed states. In some embodiments, the valve system 14 may utilize the pressure of pipe fluid 58 (e.g., formation fluid, pumped fluid from the surface 24, or a combination thereof) to motivate operation of the valve system 14 and change the open or closed state of the valve 20. As such, the compensator section 56 may utilize a compensator assembly 60 to harness the pressure of the pipe fluid 58, and pressurize one or more hydraulic lines 62. In some embodiments, the hydraulic lines 62 may be part of a self-contained (e.g., within the valve system 14) hydraulic system that is isolated from the pipe fluid 58. For example, the hydraulic lines 62 and the compensator assembly 60 may be prefilled with an amount of hydraulic fluid (e.g., hydraulic oil, cleaned reservoir fluid/oil, synthetic oil, or other suitable fluid) that is not replaced with pipe fluid 58. Indeed, the pipe fluid 58 may include sediment, debris, and/or compounds undesirable for operation in a hydraulic system. For example, certain compounds may cause components of the hydraulic system to fuse or otherwise stick in place, while sediment may cause fluid blockages and/or mechanical blockages within the hydraulic system. As should be appreciated, the hydraulic fluid may be considered "clean" as having minimal particulate matter or undesired impurities.

Pressurized pipe fluid 58 may enter the compensator assembly 60 through a filter assembly 64 (e.g., one or more particulate filters) and cause pressurization of the hydraulic lines 62. Additionally, the trigger section 54 may include a trigger 66 to regulate a controlled hydraulic line 68, which may be used alone or in conjunction with a hydraulic line 62 from the compensator assembly 60 to motivate a mechanical actuator 70 of the actuator section 52. In some embodiments, the trigger 66 may regulate the pressure of the controlled hydraulic line 68 between the pressure of the hydraulic line 68 from the compensator assembly 60 and a lower pressure, such as an environmental pressure (e.g., the pressure downhole 26, outside of the valve system 14, for example in the annulus 34). Indeed, in some embodiments, when the pipe fluid 58 is pressurized to actuate the valve 20, the environmental pressure may be less than that of the pipe fluid 58. In some embodiments, the trigger 66 may reduce the pressure of the controlled hydraulic line 68, such as via an environmental port 72 causing a pressure differential 74 in the mechanical actuator 70, by which an armature 76 thereof may be actuated. The armature 76 of the mechanical actuator 70 may actuate the valve 20 between the open and closed states. Additionally, in some embodiments, the valve system 14 may include an extension section 78 of one or more mechanical extensions of the armature 76 to translate the mechanical force of the mechanical actuator 70 to the valve 20.

The trigger 66 may be triggered electronically (e.g., via an electrical control signal), mechanically (e.g., via cabling), or hydraulically such as via a series of pressure pulses in the pipe fluid 58. For example, in some embodiments, the trigger 66 may include a ratcheting mechanism that, after a prescribed number of increases and decreases in the pressure of the hydraulic lines 62 from the compensator assembly 60, may change (e.g., decrease) the pressure of the controlled hydraulic line 68, motivating the mechanical actuator 70. In some embodiments, to control the cycling of pressure in the hydraulic lines 62, a pump of the surface equipment 30 may cyclically increase and decrease the pressure of the pipe fluid 58, thereby controlling actuation of the valve 20 from the surface 24.

Figure 3:
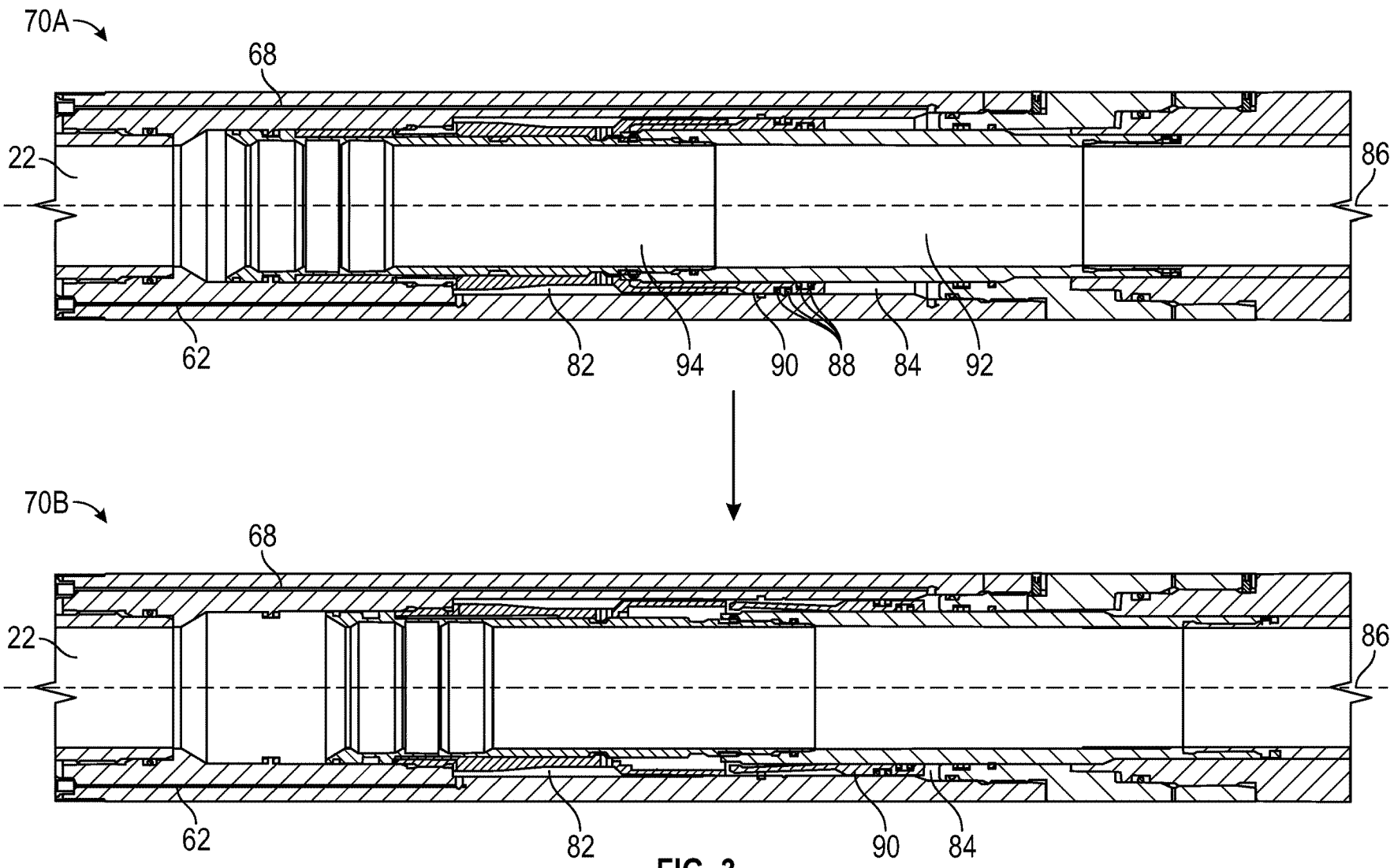
FIG. 3 is a cross-sectional schematic diagram of a mechanical actuator of the valve system of FIG. 2 transitioning from a first state to a second state, in accordance with an embodiment.

As discussed above, the pressure differential 74 between the pressure of the hydraulic line 62 from the compensator assembly 60 and the environment (or other lowered pressure) may motivate movement of the mechanical actuator 70. To help illustrate, FIG. 3 is a cross-sectional schematic diagram of an example mechanical actuator in a first state 70A and a transitioned mechanical actuator in a second state 70B. In some embodiments, the mechanical actuator includes a first hydraulic pressure chamber 82 coupled to a hydraulic line 62 from the compensator assembly 60 and a second hydraulic pressure chamber 84 coupled to the controlled hydraulic line 68. In the depicted embodiment, the hydraulic pressure chambers 82, 84 are annular chambers about an axis 86 shared with the piping 22. In some scenarios, disposing the components of the valve system 14 as radially surrounding (e.g., coaxial or concentric with) the piping 22 may provide for compact execution. However, as should be appreciated, the components of the valve system 14 may also be implemented laterally or radially offset from the axis 86 of the piping 22.

The hydraulic pressure chambers 82, 84 may be separated by one or more seals 88 (e.g., annular seals) on one or more collets 90 (e.g., annular collet(s) 90). The collet(s) 90 may hold one or more mandrels 92, 94 (e.g., annular mandrels) in place. In some embodiments, one or more mandrels 92, 94 may be coupled to or integral with the armature 76 for actuating the valve 20. When both pressure chambers 82, 84 are at the pressure of the hydraulic lines 62 (e.g., untriggered), the pressure equilibrium retains the collet 90 and mandrels in the first state 70A. However, when a pressure differential 74 occurs, such as the controlled hydraulic line 68 transitioning to a lower pressure (e.g., environmental pressure), the pressure differential 74 between the pressure chambers 82, 84 drives the collet 90 axially along the axis 86, thereby allowing the mandrel(s) 92, 94 to translate axially, providing for mechanical actuation of the valve 20. As should be appreciated, the movements (e.g., axial movement, radial movement, and/or azimuthal movement) of the collet(s) 90, mandrel(s) 92, 94, and armature 76 relative to the axis 86 may vary based on implementation. Moreover, the mechanical actuator 70 and the trigger 66 described herein are given as examples, and different implementations may utilize the pressures of the hydraulic lines 62 of the compensator assembly 60 in different manners to achieve the mechanical motion of an armature 76 for actuating a downhole tool (e.g., valve 20).

Figure 4:
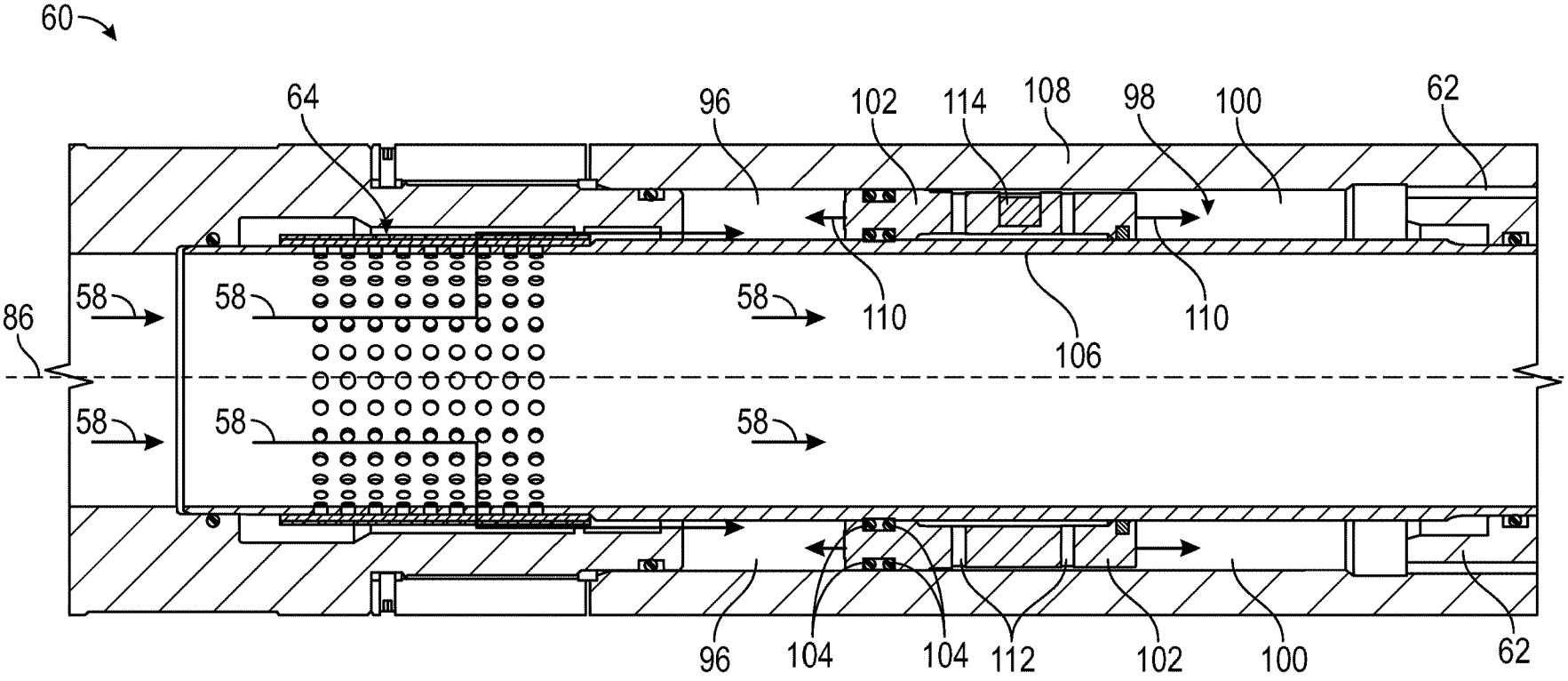
FIG. 4 is a cross-sectional schematic diagram of a compensator assembly of the valve system of FIG. 2, in accordance with an embodiment.

FIG. 4 is a cross-sectional schematic diagram of a compensator assembly 60 disposed about the axis 86 of the piping 22. As discussed herein, the compensator assembly 60 may provide for transfer of the potential energy of the pressure of the pipe fluid 58 within the piping 22 to the valve system 14 for use in generating mechanical energy, such as to actuate a valve 20. For example, in some embodiments, pipe fluid 58 may enter the compensator assembly 60 and be directed to a dirty portion 96 (e.g., dirty piston chamber) of a piston chamber 98. As discussed above, components of the valve system 14 may be disposed radially about the axis 86 of the piping 22 or otherwise the flow of the pipe fluid 58. As such, in some embodiments, the piston chamber 98 may be an annular chamber radially about and separated from the flow of the pipe fluid 58 through the piping 22 (e.g., coaxial or concentric with axis 86). Furthermore, annular components or chambers discussed herein may also be implemented as a partial annulus (e.g., disposed radially about the axis 86 less than a full 360 degrees, less than 270 degrees, less than 180 degrees, less than 90 degrees, and so on). Alternatively, the piston chamber 98 may be laterally adjacent to the piping 22.

A clean portion 100 (e.g., clean piston chamber) of the piston chamber 98 may be fluidly coupled (e.g., directly fluidly coupled) to the hydraulic lines 62 and filled with a hydraulic fluid (e.g., hydraulic oil or other fluid). A piston 102 (e.g., annular piston coaxial or concentric with axis 86) disposed within the piston chamber 98 may include one or more seals 104 (e.g., annular seals) to isolate the dirty portion 96 of the piston chamber 98 from the clean portion 100 of the piston chamber 98. In the illustrated embodiment, the piston 102 excludes any internal fluid passages and valves (e.g., check valves) to enable fluid flow between the dirty portion 96 and the clean portion 100 of the piston 102, such that the piston 102 (along with seals 104) effectively isolates the clean portion 100 from the dirty portion 96. In other words, the piston 102 (along with seals 104) blocks any dirty fluid from passing from the dirty portion 96 to the clean portion 100, such that the hydraulic fluid used for actuating the valve is generally the clean hydraulic fluid supplied to the piston chamber 98. An inner wall 106 of the compensator assembly 60 may define a barrier between the piston chamber 98 and the piping 22. As used herein, the valve system 14 may be considered to include piping 22 therein, such as in coaxial implementations of the valve system 14 (e.g., implementations of the valve system 14 disposed, at least in part, radially around the fluid flow of the pipe fluid 58). Additionally, an outer wall 108 (e.g., annular wall) of the compensator assembly 60 may define a barrier between the piston chamber 98 and an environment of the compensator assembly 60. As should be appreciated, one or more additional walls may also be utilized depending on implementation. In some embodiments, the piston chamber 98 may allow the piston 102 a degree of freedom for translational movement 110 in the axial direction, relative to the axis 86, depending on the relative pressures of the clean portion 100 and dirty portion 96 of the piston chamber 98. For example, when the pressure of the pipe fluid 58 is increased, the piston 102 may translate towards the clean portion 100 of the piston chamber 98, transferring the pressure of the pipe fluid 58 to the hydraulic fluid in the hydraulic lines 62.

In some embodiments, the clean portion 100 of the piston chamber is prefilled with hydraulic fluid (e.g., prior to downhole deployment), along with the hydraulic lines 62, such that the piston 102 "free floats" within the piston chamber 98. In other words, during non-pressurized conditions, the piston 102 may move back and forth within the piston chamber 98, self-adjusting for thermal expansion and/or compressibility of the hydraulic fluid without expelling the hydraulic fluid from the clean portion 100 of the hydraulic system (e.g., clean portion 100 of the piston chamber 98 and hydraulic lines 62). Furthermore, in some embodiments, the piston 102 may include one or more radial holes 112 to aid in removing air pockets when filling the hydraulic system. Additionally, and as discussed further below, the piston 102 may include a locating magnet 114 (e.g., annular or partially annular magnet coaxial or concentric with axis 86) to, when utilized with a magnetic indicator disposed on an exterior surface of the compensator assembly 60 (not shown), provide a visible indicator of the location of the piston 102 from outside of the compensator assembly 60, such as to aid in filling the hydraulic system.

Figure 5:
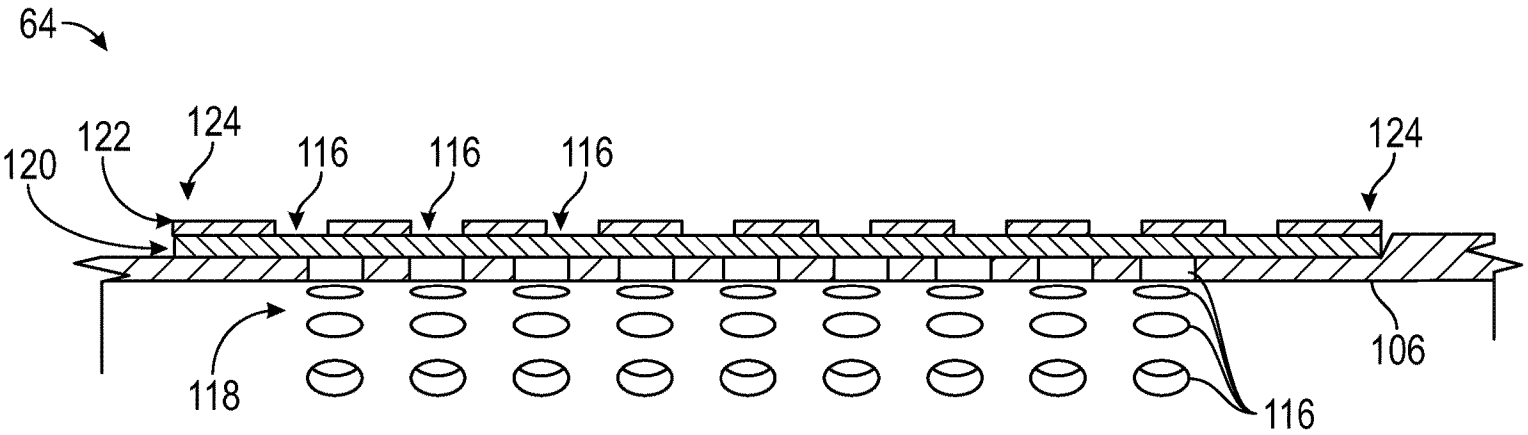
FIG. 5 is a partial cross-sectional schematic diagram of a filter assembly of the compensator assembly of FIG. 4, in accordance with an embodiment.

FIG. 5 is a partial cross-sectional schematic diagram of the filter assembly 64 (e.g., annular filter assembly coaxial or concentric with axis 86) of the compensator assembly 60. In some embodiments, the inner wall 106 (e.g., annular filter wall) may include multiple holes 116 to act as a large particle debris filter 118 (e.g., first filter stage). The holes 116 may include a plurality of annular arrangements of holes at a plurality of axial locations along the axis 86. For example, the holes 116 in the large particle debris filter 118 may be less than or equal to 1 inch in diameter, less than or equal to 0.5 inches in diameter, less than or equal to 0.25 inches in diameter, less than or equal to 0.125 inches in diameter, or less than or equal to 0.0625 inches in diameter depending on implementation. Additionally, the filter assembly 64 may include one or more additional filter stages such as a small particle debris filter 120 (e.g., annular filter wall) such as a wire mesh disposed after, relative to the flow path of the pipe fluid 58 to the piston chamber 98, the large particle debris filter. For example, the small particle debris filter 120 may have openings greater than or equal to 1 micron in diameter, greater than or equal to 10 microns in diameter, greater than or equal to 100 microns in diameter, greater than or equal to 250 microns in diameter, greater than or equal to 500 microns in diameter, or greater than or equal to 1000 microns in diameter depending on implementation. Thus, the small particle debris filter 120 has openings generally smaller than the holes 116 in the inner wall 106, such as openings that are less than 10, 20, 30, 40, or 50 percent of a diameter of the holes 116. In some embodiments, the filter assembly 64 may include multiple concentric layers (e.g., 2, 3, 4, 5, 6, 7, 8, 9, 10 or more) or filter stages of annular filters (or filter walls) that progressively decrease in diameter of filter openings, thereby progressively filtering out smaller sized particulate. Furthermore, in some embodiments, a filter guard 122 (e.g., final filter stage) may be disposed after the small particle debris filter 120 such that the small particle debris filter 120 and/or other filter stages are sandwiched (e.g., annularly sandwiched) between the large particle debris filter 118 and the filter guard 122. In some embodiments, the filter guard 122 may have holes 116 of the same size and/or order of magnitude as the large particle debris filter 118 and may or may not align with the large particle debris filter 118. Moreover, the filter guard 122 may provide additional structural support and rigidity to the small particle debris filter 120. In some embodiments, the components of the filter assembly 64 are metallic (e.g., steel) and circumferentially welded together (e.g., at axial ends 124), such as to prevent leakage of the pipe fluid 58 into the piston chamber 98 without filtering. As should be appreciated, although shown as round holes 116 and described with respect to diameters, the shape of the openings through the filter assembly 64 may be of any suitable shape (e.g., rectangular, hexagonal, triangular, to name a few).

Figure 6:
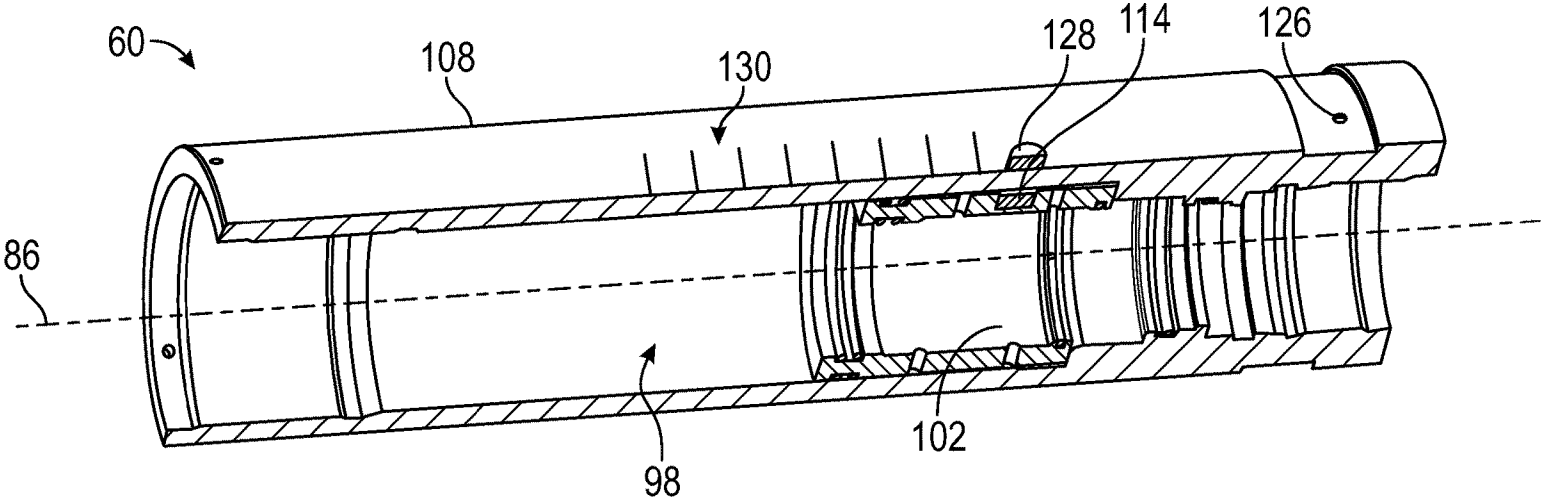
FIG. 6 is a perspective cutaway view of a portion of the compensator assembly of FIG. 4, in accordance with an embodiment.

FIG. 6 is a perspective cutaway of a portion of the compensator assembly 60 including the piston 102 and the outer wall 108. In some embodiments, the compensator assembly 60 may include a fill port 126 (e.g., hydraulic port or fitting) to facilitate filling the hydraulic lines 62 and clean portion 100 of the piston chamber 98. However, as stated above, the piston 102 may free float within the piston chamber 98 to allow for thermal expansion and/or compressibility. As such, it may be useful to know the location of the piston 102 within the piston chamber 98 when filling, to prevent over or underfill conditions. In some embodiments, the piston 102 may include a locating magnet 114, which may be annular, semi-annular, or disposed at a single radial location, such as corresponding to less than 90 degrees of azimuth. The locating magnet 114 may provide minimal resistance to the translational movement 110 of the piston 102, and when used in conjunction with a magnetic indicator 128 (e.g., a magnet or magnetic material) placed on the outside (e.g., radial exterior) of the outer wall 108, the relative location of the piston 102 may be viewed from outside the outer wall 108. For example, in some embodiments, the outer wall 108 may include indicator markings 130 (e.g., a series of parallel lines oriented crosswise to the axis 86) etched, written, or otherwise visible on the radial exterior of the outer wall 108, and the location of the magnetic indicator 128 relative to the indicator markings 130 may identify the location of the piston 102 relative to the piston chamber 98 and/or relative to a preset fill level of the hydraulic system. The magnetic indicator 128 may include a round, rectangular, or other shaped block that can slide along the outer wall 108 over and/or adjacent the indicator markings 130. In some embodiments, the indicator markings 130 may be arranged in an axial channel or recessed groove (or between parallel axial protrusions), which helps to guide the magnetic indicator 128 along the indicator markings 130.

Figure 7:
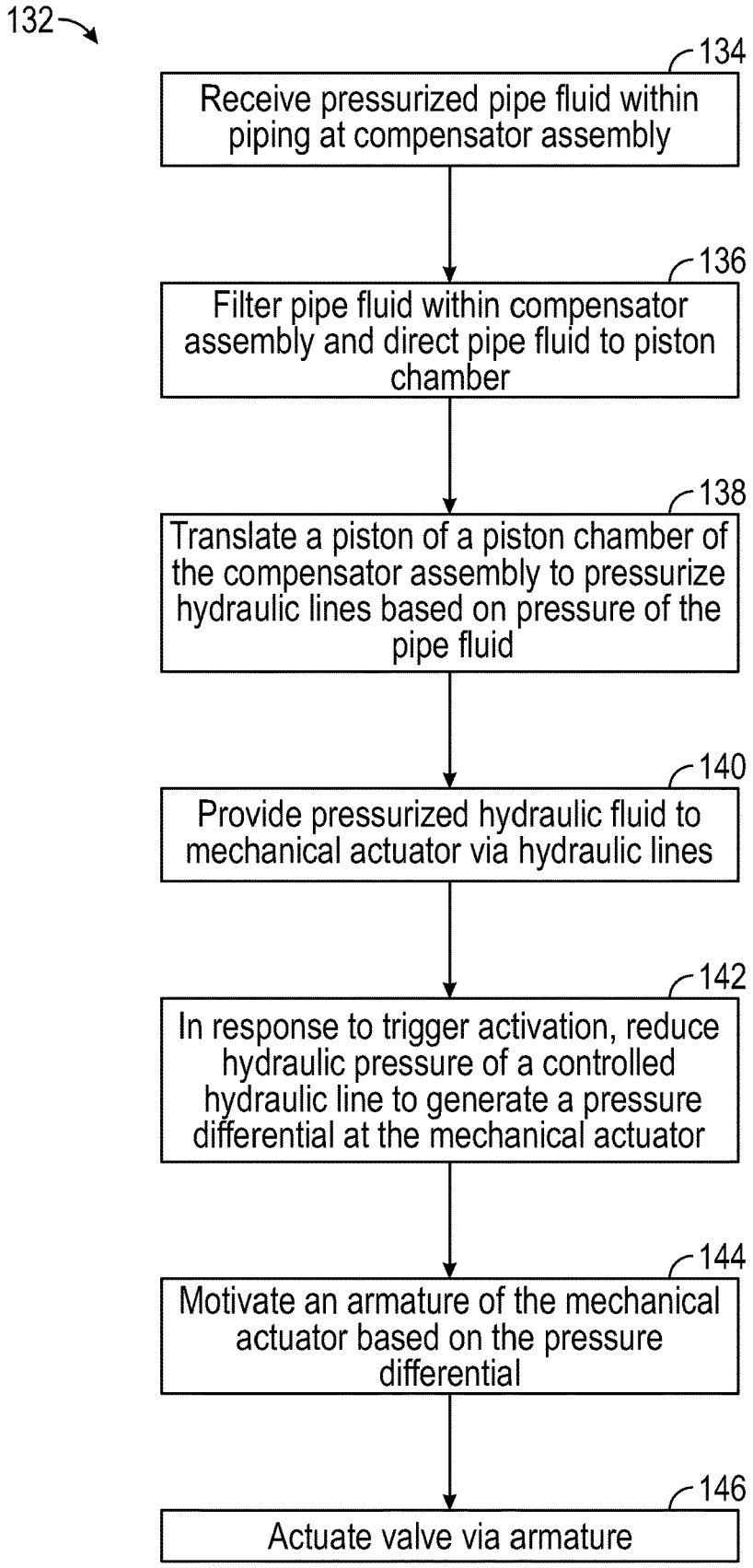
FIG. 7 is a flowchart of an example process for operating the valve system of FIG. 2, in accordance with an embodiment.

FIG. 7 is a flowchart of an example process 132 for operating a valve system 14 with a compensator assembly 60. The compensator assembly 60 may receive pressurized pipe fluid 58 (e.g., at a pressure greater than the environment of the valve system 14, such as downhole 26) via piping 22 within a wellbore 16 (process block 134). In some embodiments, the compensator assembly 60 may filter the pipe fluid 58 (e.g., via a filter assembly 64) and direct the pipe fluid 58 to a piston chamber 98 of the compensator assembly 60 (process block 136). Additionally, a piston 102 may be shifted within a piston chamber 98 of the compensator assembly 60 to pressurize one or more hydraulic lines 62 based on the pressure of the pipe fluid 58 (process block 138). Pressurized hydraulic fluid may be provided to a mechanical actuator 70 via the hydraulic line(s) 62 (process block 140). Additionally, in response to the activation of a trigger 66, the hydraulic pressure of a controlled hydraulic line 68 may be reduced (e.g., via the trigger 66) to generate a pressure differential 74 at the mechanical actuator 70 (process block 142). For example, the pressure of the controlled hydraulic line 68 may be relieved via an environmental port 72 fluidly coupled to the trigger 66. Moreover, any suitable trigger 66 may be utilized, such as triggered electronically, mechanically, or hydraulically (e.g., via a series of pressure increases and decreases of the pipe fluid 58). Additionally, an armature 76 of the mechanical actuator 70 may be motivated (e.g., caused to move) based on the pressure differential 74 (process block 144), which may, in turn, actuate a valve 20 (process block 146) or other downhole tool.

Technical effects of the present disclosure allow for increased reliability of actuators, such as for valves 20, of a well string 12 disposed within a wellbore 16 by effectively harnessing the potential energy of the pressure of pipe fluid 58 within piping 22 downhole 26. Furthermore, the accuracy of hydraulic filling may be increased due fill level indicators and/or reduced air pockets, which may further increase the reliability of a desired actuation. As should be appreciated, although the flowchart of FIG. 7 is shown in a given order, in certain embodiments, portions of the flowchart may be reordered, deleted, occur simultaneously, and/or be initiated/controlled by one or multiple data processing systems 38.

The subject matter described in detail above may be exampled by, but not limited to, one or more embodiments, as set forth below, which may be used in any combination thereof.

The invention claimed is:

1. A valve system of a well string, the valve system comprising:

a compensator assembly configured to receive a pipe fluid via piping, the compensator assembly comprising:

a piston chamber; and a piston disposed within the piston chamber and configured to fluidly isolate a first portion of the piston chamber from a second portion of the piston chamber, wherein the first portion is operatively fluidly coupled to the piping to receive the pipe fluid and the second portion is operatively filled with a hydraulic fluid and coupled to one or more hydraulic lines, and wherein the piston comprises a degree of freedom to translate within the piston chamber such that an increase in a first pressure of the pipe fluid in the first portion of the piston chamber motivates the piston to translate and increase a second pressure of the hydraulic fluid in the second portion of the piston chamber;

a mechanical actuator coupled to at least one of the one or more hydraulic lines and configured to articulate an armature in response to a pressure differential, wherein the pressure differential is based on the second pressure;

a valve configured to transition between an open state and a closed state in response to articulation via the armature; and a trigger configured to regulate a third pressure of a controlled hydraulic line fluidly coupled to the mechanical actuator, the pressure differential comprises a difference between the third pressure and the second pressure.

2. The valve system of claim 1, wherein the second portion of the piston chamber and the one or more hydraulic lines are operatively filled with an amount of the hydraulic fluid such that the piston translates freely within the piston chamber along the degree of freedom without abutting an end of the piston chamber and without expelling the hydraulic fluid in response to a thermal expansion of the hydraulic fluid.

3. The valve system of claim 1, wherein the piston comprises a locator magnet configured to generate a magnetic field such that a magnetic indicator disposed on an outer surface of the compensator assembly is attracted to the magnetic field to align with the locator magnet and to provide a visual indication of a relative location of the piston within the piston chamber.

4. The valve system of claim 1, wherein the piston chamber comprises an annular piston chamber disposed radially about an axis of the piping between a first annular wall and a second annular wall, wherein the first annular wall separates the piston chamber from an interior of the piping, and wherein the degree of freedom is in an axial direction relative to the axis.

5. The valve system of claim 4, wherein the first portion of the piston chamber is configured to receive the pipe fluid via a filter assembly comprising a first filter stage, wherein the first filter stage comprises a first plurality of openings through the first annular wall.

6. The valve system of claim 5, wherein the filter assembly comprises a second filter stage radially outward from the first filter stage, wherein the second filter stage comprises a second plurality of openings smaller than the first plurality of openings.

7. The valve system of claim 6, wherein the filter assembly comprises a filter guard disposed radially outward from the second filter stage, wherein the filter guard comprises a third plurality of openings larger than the second plurality of openings.

8. The valve system of claim 7, wherein the first filter stage, the second filter stage, and the filter guard are welded together circumferentially about the axis such that the pipe fluid operatively flows from the interior of the piping, through the first filter stage, through the second filter stage, through the filter guard, and into the first portion of the piston chamber.

9. The valve system of claim 1, wherein the trigger is configured to maintain the third pressure equal to the second pressure before being triggered and, in response to being triggered, reduce the third pressure to an environmental pressure of the valve system.

10. The valve system of claim 9, wherein the trigger comprises an environmental port configured to relieve the third pressure to the environmental pressure of an annulus of a wellbore in response to being triggered.

11. A method of operating a downhole valve system comprising:

receiving, via a filter assembly of a compensator assembly, pipe fluid into a first portion of a piston chamber of the compensator assembly from downhole piping;

pressurizing the pipe fluid within the first portion of the piston chamber;

in response to a first pressure of the pipe fluid, translating a piston of the compensator assembly within the piston chamber to pressurize hydraulic fluid in a second portion of the piston chamber fluidly coupled to one or more hydraulic lines to a second pressure, wherein the second pressure is based on the first pressure, wherein the piston fluidly isolates the first portion of the piston chamber from the second portion of the piston chamber;

providing, via the one or more hydraulic lines, the hydraulic fluid at the second pressure to a mechanical actuator;

in response to activation of a trigger, reducing a third pressure of a controlled hydraulic line fluidly coupled to the mechanical actuator to generate a pressure differential between the third pressure and the second pressure at the mechanical actuator;

motivating an armature of the mechanical actuator based on the pressure differential; and actuating a valve of the downhole piping via the armature.

12. The method of claim 11, wherein the second portion of the piston chamber and the one or more hydraulic lines are operatively filled with an amount of the hydraulic fluid such that the piston translates with a single degree of freedom within the piston chamber without abutting an end of the piston chamber and without expelling the hydraulic fluid in response to a thermal expansion of the hydraulic fluid.

13. The method of claim 12, wherein the piston chamber comprises an annular piston chamber disposed radially about an axis of the downhole piping between a first annular wall and a second annular wall, wherein the first annular wall separates the piston chamber from an interior of the downhole piping, and wherein the single degree of freedom is in an axial direction relative to the axis, and wherein the filter assembly is configured to filter the pipe fluid received into the first portion of the piston chamber, the filter assembly comprising:

a first plurality of openings through the first annular wall;

an annular filter guard radially outward from the first annular wall and radially inward from the second annular wall and comprising a second plurality of openings; and an annular wire mesh disposed radially between the first annular wall and the annular filter guard and comprising a third plurality of openings smaller than the first plurality of openings and the second plurality of openings.

* * * * *